US005103734A

United States Patent [19]

Arnaud et al.

[11] Patent Number: 5,103,734

[45] Date of Patent: Apr. 14, 1992

[54] PERIPHERAL CASING FOR A GUIDED MUNITION FIRED WITH A CANNON EFFECT

[75] Inventors: Philippe Arnaud, Orleans la Source; Marc Bernard, Marcilly en Villette; Hervé Boubault, Olivet; René Thouron, La Ferte St Aubin, all of France

[73] Assignee: Thomson-Brandt Armements, Boulogne Billancourt, France

[21] Appl. No.: 631,098

[22] Filed: Dec. 19, 1990

[30] Foreign Application Priority Data

Dec. 19, 1989 [FR] France ..... 8916791

[51] Int. Cl.[5] ..... F42B 12/62

[52] U.S. Cl. ..... 102/489; 102/293; 102/357; 102/377

[58] Field of Search ..... 102/293, 340, 342, 351, 102/357, 374, 377, 378, 393, 489

[56] References Cited

U.S. PATENT DOCUMENTS

| | | | |
|---|---|---|---|
| 1,003,082 | 9/1911 | Ziegenfuss | 102/357 |
| 3,140,886 | 7/1964 | Cotilla et al. | 102/293 |
| 3,705,550 | 12/1972 | Long | 102/378 |
| 4,648,321 | 10/1987 | Lusk | 102/293 |
| 4,823,700 | 4/1989 | Alker et al. | 102/489 |

FOREIGN PATENT DOCUMENTS

| | | | |
|---|---|---|---|
| 323788 | 7/1989 | European Pat. Off. . | |
| 2327827 | 1/1974 | Fed. Rep. of Germany | 102/340 |
| 3725036 | 2/1989 | Fed. Rep. of Germany | 102/374 |
| 1579025 | 8/1969 | France . | |
| 2336656 | 7/1977 | France . | |
| 520890 | 5/1940 | United Kingdom . | |

*Primary Examiner*—Harold J. Tudor

*Attorney, Agent, or Firm*—Oblon, Spivak, McClelland, Maier & Neustadt

[57] ABSTRACT

The invention concerns a guided munition, fired from a launching system with a cannon effect. This munition comprising sub-assemblies is supported, during acceleration in the cannon, by a peripheral casing which rests on the first sub-assembly of the munition placed at the front of the munition and is fixed to an ejectable sub-assembly placed at the rear of the munition. The weight of this casing is necessary to withstand the forces due to acceleration and it enables the range of the munition to be increased during the ballistic phase. During the transition from the ballistic phase to the guided phase, the ejectable sub-assembly is ejected, taking with it the casing which thus frees the airfoil surfaces to open out. The casing thus positioned also provides sealing and protection of the sensitive parts and rigidity of the whole of the munition.

11 Claims, 5 Drawing Sheets

PERIPHERAL CASING FOR A GUIDED MUNITION FIRED WITH A CANNON EFFECT

BACKGROUND OF THE INVENTION

The invention concerns a guided munition, fired by a launching system with a cannon effect. It concerns more particularly the external structure of a munition, i.e. the peripheral casing giving cohesion of the various sub-assemblies forming the guided munition.

SUMMARY OF THE INVENTION

The aim of the invention is to make a structure for a guided munition fired by a cannon effect ensuring sealing of the sub-assemblies placed inside the munition, protection of the sensitive parts against external conditions, maximum range, locking and unlocking of spreadable lifting surface and rigidity of the whole of the munition.

The object of the invention is a guided munition comprising a first sub-assembly placed at the front of the munition and rear sub-assemblies positioned behind the first sub-assembly along an axis X'X which is the longitudinal axis of the munition, characterized by the fact that it comprises a releasable cylindrical casing, positioned around the periphery of the rear sub-assemblies, fixed at its rear end to an ejectable rear sub-assembly placed at the rear of the munition, its front end resting on a rear part of the first sub-assembly, this casing comprising:

means of fixing to ensure locking and unlocking of the casing on one of the rear sub-assemblies of the munition by a first means of linking;

means of access to act on at least one second means of linking, which both provides a link between two subassemblies and ensures that the two sub-assemblies and the casing are fixed together.

BRIEF DESCRIPTION OF THE DRAWINGS

Other characteristics and advantages of the invention will appear on reading the detailed description below made with reference to the appended drawings, on which.

DESCRIPTION OF THE PREFERRED EMBODIMENTS

Figure 1:
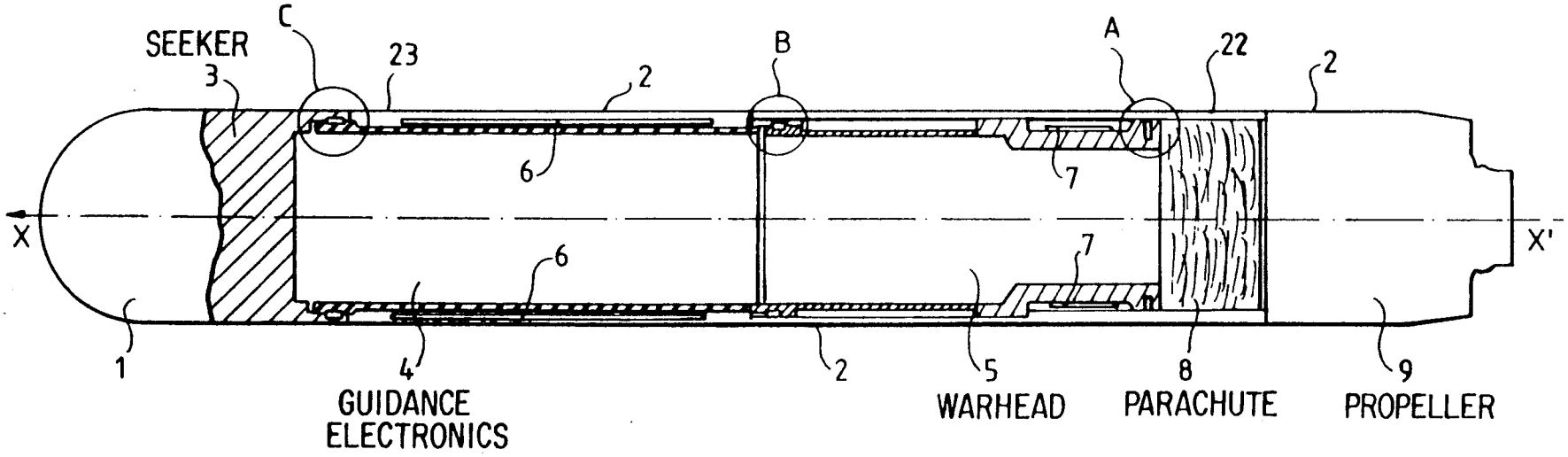
FIG. 1 represents a guided munition according to the invention.
Figure 4:
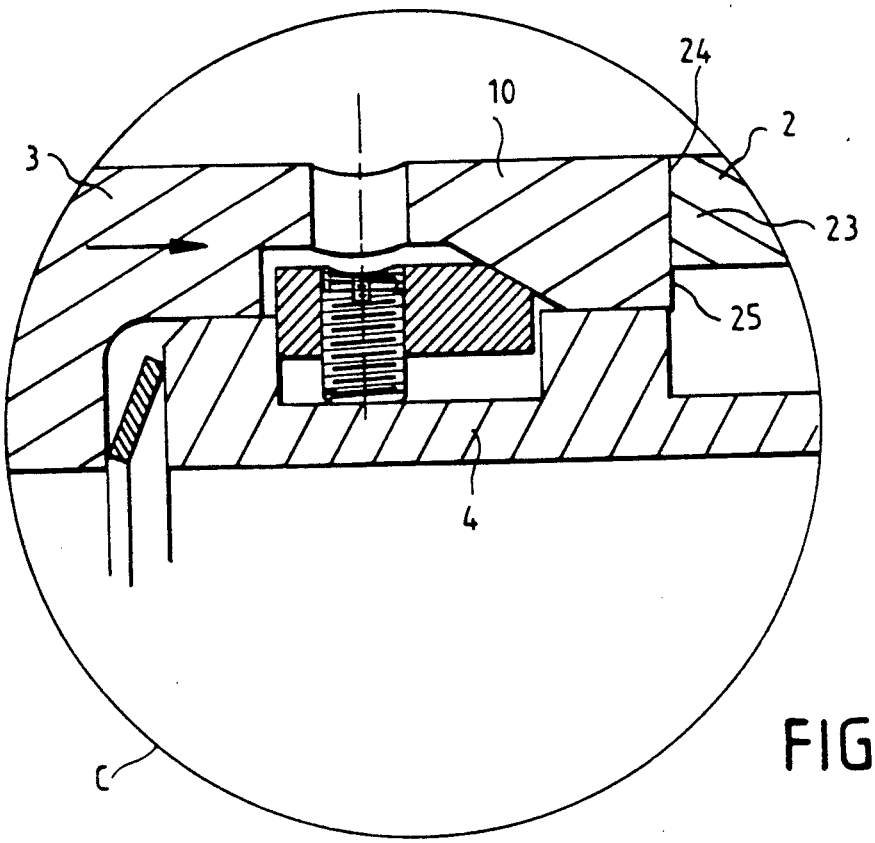
FIG. 4 represents a detailed view of the point C of FIG. 1.

FIG. 1 is a diagram of a guided munition 1, equipped with a releasable cylindrical casing 2 according to the invention. The munition 1 comprises various sub-assemblies, for example, juxtaposed and positioned along an axis X'X which is the longitudinal axis of the munition 1; these sub-assemblies are composed, for example, of a first sub-assembly, for example a seeker 3, placed at the front of the munition 1, and of rear sub-assemblies, for example, guidance electronics and its components 4, a warhead 5, a braking system, for example, a parachute 8, a gas generator, for example, a propeller 9 enabling the range of the munition 1 to be increased and the releasable casing 2 fixed to a rear end 22 of an ejectable sub-assembly, for example, parachute 8. This casing 2 positioned after the fitting together of the various sub-assemblies does not completely cover all the sub-assemblies making up the munition. As shown in FIG. 4, the casing 2 does not cover the seeker 3 of the munition 1 placed on the front part of the munition 1. A front end 23 of the casing 2 rests on a rear part 10 of the seeker 3 in such a way that a bearing face 24 of the casing 2 rests on a face 25 of the seeker 3 ensuring alignment of the surfaces of the two parts so that the external peripheral surface of the munition has, for example, a uniform and cylindrical structure. The uniformity facilitates handling of the munition, whether during storage of the munitions, for example, or during its installation in launching systems, for example, while ensuring sealing of the various sub-assemblies and protection of the sensitive parts of the munition against external conditions. The cylindrical geometry of the structure enables reduction of the aerodynamic drag during a first phase of the munition 1 called the ballistic phase. This phase, following firing of the munition for example from a cannon, requires rigidity to withstand the forces due to acceleration in the tube; in addition a smooth surface minimizes friction inside the tube but sufficient weight also improves the range of the munition. To ensure rigidity of the sub-assemblies with respect to each other and with respect to the casing 2, means of linking have been positioned between each of the sub-assemblies, for example, at points A, B and C as shown in FIG. 1. This embodiment is non-restrictive and the number of points can vary if there are more or fewer sub-assemblies in the munition. These means of linking are shown in more detail in FIGS. 2, 3 and 4 representing respectively the points A, B and C when the casing 2 is made to rest on the seeker 3.

Figure 2:
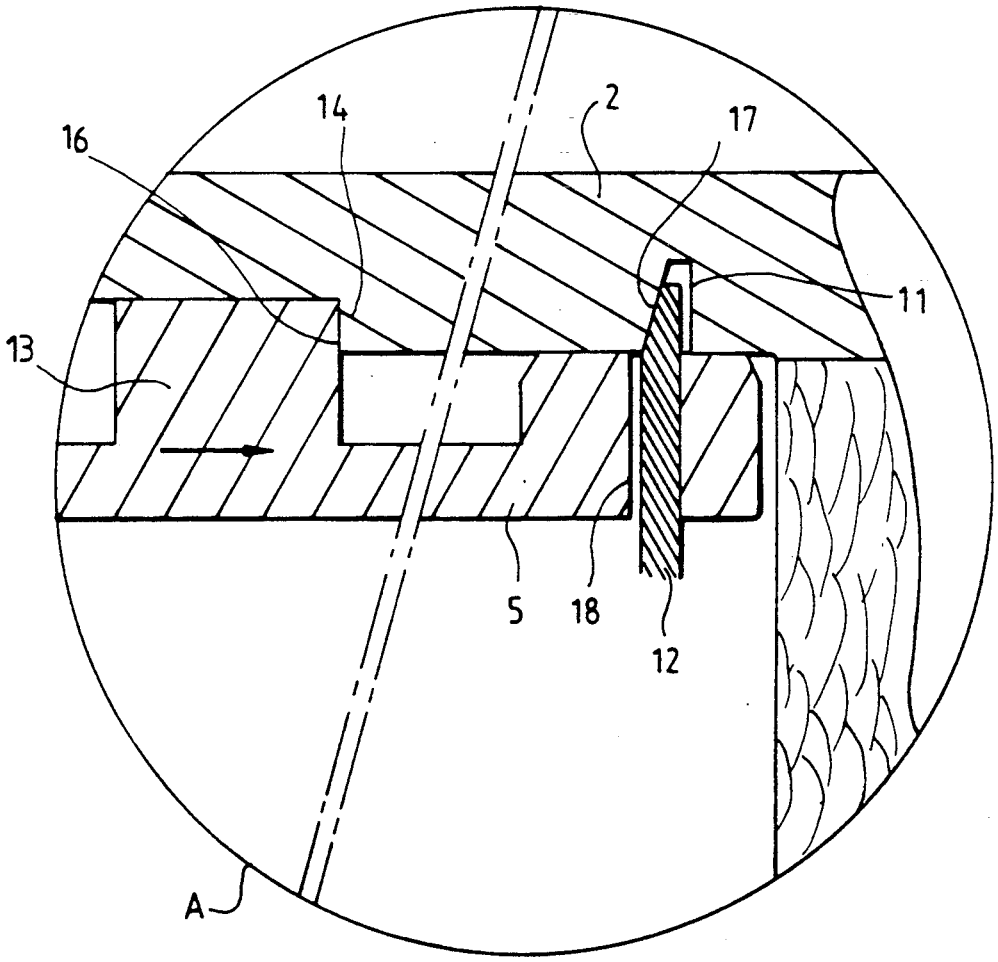
FIG. 2 represents a detailed view of the point A of FIG. 1.
Figure 3:
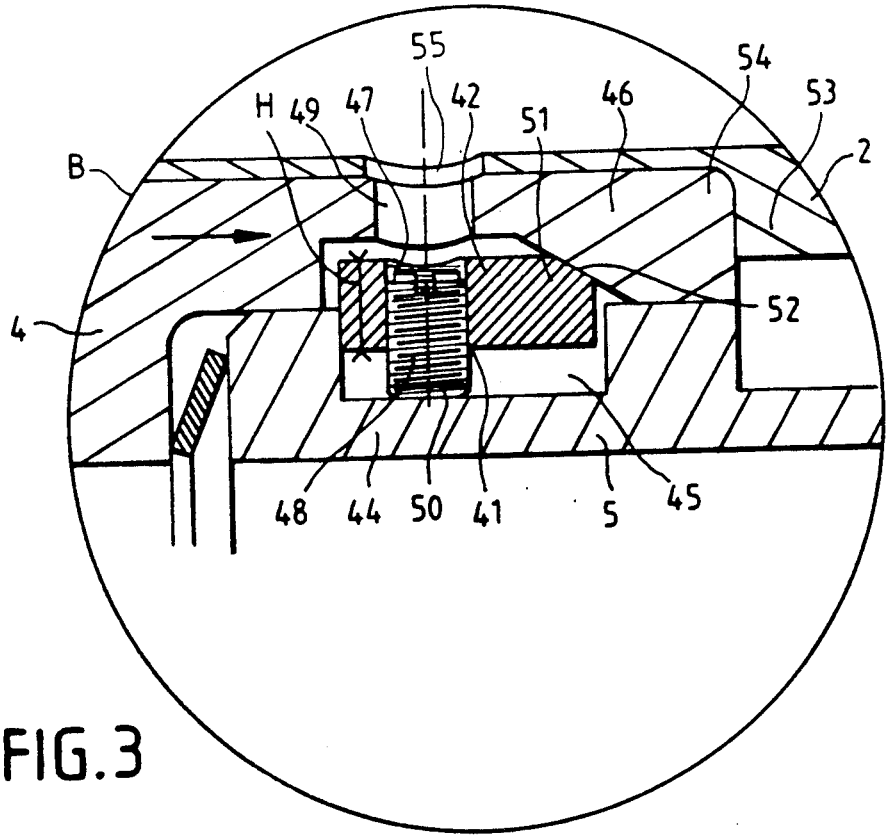
FIG. 3 represents a detailed view of the point B of FIG. 1.

FIGS. 2, 3 and 4 will be described later in that order, as since the casing is ejected towards the rear, the operations enabling the whole of the munition to be made rigid are performed in the opposite sense, i.e. along the axis X'X.

Figure 6:
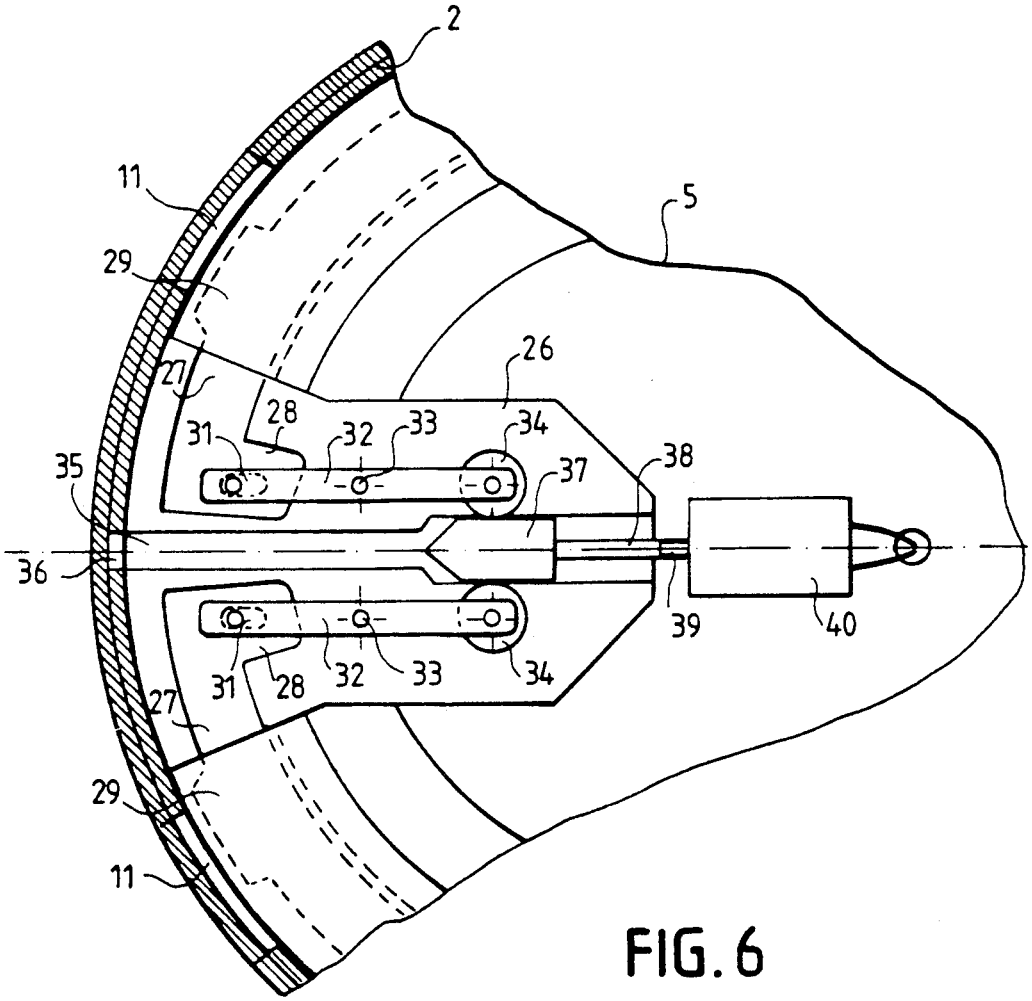
FIG. 6 represents a first linking device equipping, for example, a munition according to the invention.

Before the various sub-assemblies are covered by the casing 2, they are held together, for example, by means of locking and unlocking or means of linking, which are positioned on the periphery of the sub-assemblies; these means of linking are, for example, elastic or pyrotechnic and enable assembly of the sub-assemblies without damage to the sensitive parts of each of the sub-assemblies. To improve the operation, an elastic means constituted, for example, of a flat spring is placed between each of the sub-assemblies whose machining permits, for example, fitting of the second sub-assembly into the first sub-assembly; in the example of embodiment given, of the guidance electronics into the seeker 3. FIG. 2 represents a detailed view of the point A in FIG. 1, after covering by the casing 2, and shows the linking between the casing 2 fixed to the propeller (not shown in FIG. 2) and, for example, the warhead 5. The casing 2 comprises a structure, for example of metal. This structure is machined, at this point A, so that means of fixing, for example a notch 11 positioned, for example, on the internal periphery enables a first means of linking 12 to lock the casing 2 to the rest of the munition comprising the various sub-assemblies mentioned above, and so that the means of linking 12 ensures contact between a first part 13 of the structure of the warhead 5 and a second part 14 of the structure of the casing 2. In order to obtain a bearing surface 16 between its two sub-assemblies, the notch 11 in the casing 2 has an oblique edge 17 which, during activation of the means of linking 12, enables the latter to eliminate the play which exists between the first part 13 and the second part 14, thanks to a movement of translation in the reverse direction of the longitudinal axis X'X of the structure of the warhead 5, along the casing 2. Discontinuities formed by, among others, the first part 13 and the second part 14 placed on the structure of the warhead 5 and on the structure of the casing 2 respectively have been made so as to facilitate both the machining of each of the sub-assemblies and the translation of the casing 2 over the different sub-assemblies, the casing 2 sliding over the sub-assemblies along the axis X'X. The means of linking 12 placed, for example, on the external periphery of the structure of the warhead 5 is positioned, for example, in a groove 18 situated at the rear of the structure of the warhead 5. This means of linking 12 is, for example, a pyrotechnic device which is represented in the diagram of FIG. 6 in an unlocked position. In the groove 18 is lodged a circlip 27 whose extremities are bent inwards to form two lugs, contained in a hollowed-out part 26. The outside edge of the circlip 7 has regularly-spaced teeth 29, pointing outwards. The groove 18 is deep enough for the circlip 27 with its teeth 29 to fit into it completely when it is tightened. When the circlip is in its initial state, or deployed state, however, its teeth 29 are outside the groove 18. In the presence of the casing 2 on the structure of the warhead 5, the teeth 29 are then engaged in the corresponding notches 11 in the internal part of the casing 2. Each lug 28 of the circlip 27 comprises an oblong aperture 31 of approximately radial direction, by means of which it is articulated with an end of a connecting rod 32. The connecting rods 32 are mounted to pivot, approximately at their mid-point, about pins 33 perpendicular to the plane of the circlip 27. The other ends of the connecting rods 32 are equipped with rollers 34, approximately in the plane of the circlip 27. The presence of the rollers 34 is not strictly necessary for operation, but by reducing the friction, they reduce the energy needed to activate the device.

Between the connecting rods 32, the bottom of the hollow part 26 has a radial groove 35 whose external extremity communicates with an aperture 36 in the internal part of the casing 2. Towards the inside, the groove 35 widens on both sides before the rollers 34 and extends, thus widened, beyond these rollers.

In the wide part of the groove 35 is engaged a slide 37 which can be either between the rollers or not, depending on its position in the groove. The end of the slide 37 is a point facing outwards, so that it can become engaged between the rollers 34 when the latter are close together.

The bottom of the rear part of the groove 36 has a second narrow groove 38, in which is engaged the rod 39 of a pyrotechnic piston 40. The rod 39 projects above the groove 38, so as to be able to push the slide 37 outwards. The pyrotechnic piston is controlled by an electronic means, not represented, which thus ensures the locking and unlocking of the means of linking 12. Unlocking is achieved by placing the pyrotechnic piston 40 under pressure, its rod 39 then pushing the slide outwards between the rollers 34, bringing the ends of the circlip 27 closer together and retracting the teeth 29 which extend into the notches 11.

FIG. 3 represents a detailed view of the point B of FIG. 1 showing a second linking device 41 positioned, for example, between the guidance electronics 4 and the structure of the warhead 5, the whole being covered by the casing 2. This linking device 41 comprises, a ring 42 of an elastic material for example, positioned, for example around the external periphery of the structure of the warhead 5 and on its front end 44. The ring 42 is inserted in a groove 45 which is, for example, rectangular and the ring is of thickness H, for example, less than or equal to the depth of the groove 45 so that when the front end 44 of the structure of the warhead 5 is fitted into the rear part 46 of the guidance electronics 4, the operation is performed smoothly with no problems of bumping caused by bad dimensioning of the machined pieces. The ring 42 is intersected, for example, by at least one hole 47 which has for example been threaded to enable screwing of at least one screw 48. This screw 48 is brought into contact with the ring 42, for example, by at least a first hole 49 which has been pierced, for example, in the rear part 46 of the guidance electronics 4. To fix the two sub-assemblies together, the screw 48 is screwed into the ring 42. When the end 50 of the screw 48 comes into contact with the bottom of the groove 45, the ring 42 is raised and a side 51 of the upper part of the elastic ring comes into contact with an oblique face 52 made, for example, on the rear part 46 of the guidance electronics 4. This linking device 41 enables elimination of part of the play between the two modules, which is due also to the introduction of a flat spring 52 between each of the sub-assemblies to prevent the surfaces of these sub-assemblies from coming into contact. When the sub-assemblies are covered by the casing 2, the latter with a stop 53 comes to rest, for example, against an extremity 54 of the back part 46 of the guidance electronics 4. To ensure perfect fixing of the whole and prevent play causing poorer performances of the munition, a means of access constituted, for example, of at least a second hole 55 is made in the casing 2. This hole 55 is positioned so that, after covering the rear sub-assemblies by the casing 2, the diameter of the hole 55 is, for example, opposite the diameter of the first hole 49 of the rear part 46 of the guidance electronics 4. In this way, it is possible to turn the screw 48 so that the extremity 54 of the guidance electronics 4 comes to rest against the stop 53, which after tightening prevents any movement of one of the sub-assemblies with respect to the others. The sub-assemblies constituted, for example, of the structure of the warhead 5 and the casing 2 being fixed, due to their locking by the linking device 12, the sub-assembly constituted, for example, by the guidance electronics 4 can therefore move in the direction opposite to the axis X'X and stabilize the link.

FIG. 4 represents a detailed view of the point C on FIG. 1. In this FIG. 4 are shown the same parts represented and described in FIG. 3. FIG. 4 represents more particularly the link between the first sub-assembly of the munition, for example a seeker 3, and one of the rear sub-assemblies of the munition, for example, the guidance electronics 4. The operations performed and described with reference to FIG. 3 are made in the same way at C, the only difference being that the casing 2 does not cover, for example, the seeker 3 but rests on the rear part 10 of the structure of the seeker 3. After having screwed in the last screw at C, there is no more play inside the munition and it is ready for use. When this munition is placed inside a launching system, for example a cannon, the munition can be fired.

After firing of the munition, during the ballistic phase, the propeller 9 positioned on the rear part of the munition is ignited. Thanks to the ejection of a predetermined volume of gas, it enables the range of the munition to be increased, giving it an optimum propulsion. When this propulsion comes to an end, the munition's guided phase begins. During this phase, any useless weight is a handicap. The weight of the structure of the munition must therefore be reduced to a minimum. As the propeller and the casing act only during the ballistic phase, the weight of the propeller and that of the casing which is attached to it by a fixing system can be ejected to improve the munition's guided phase.

Figure 5:
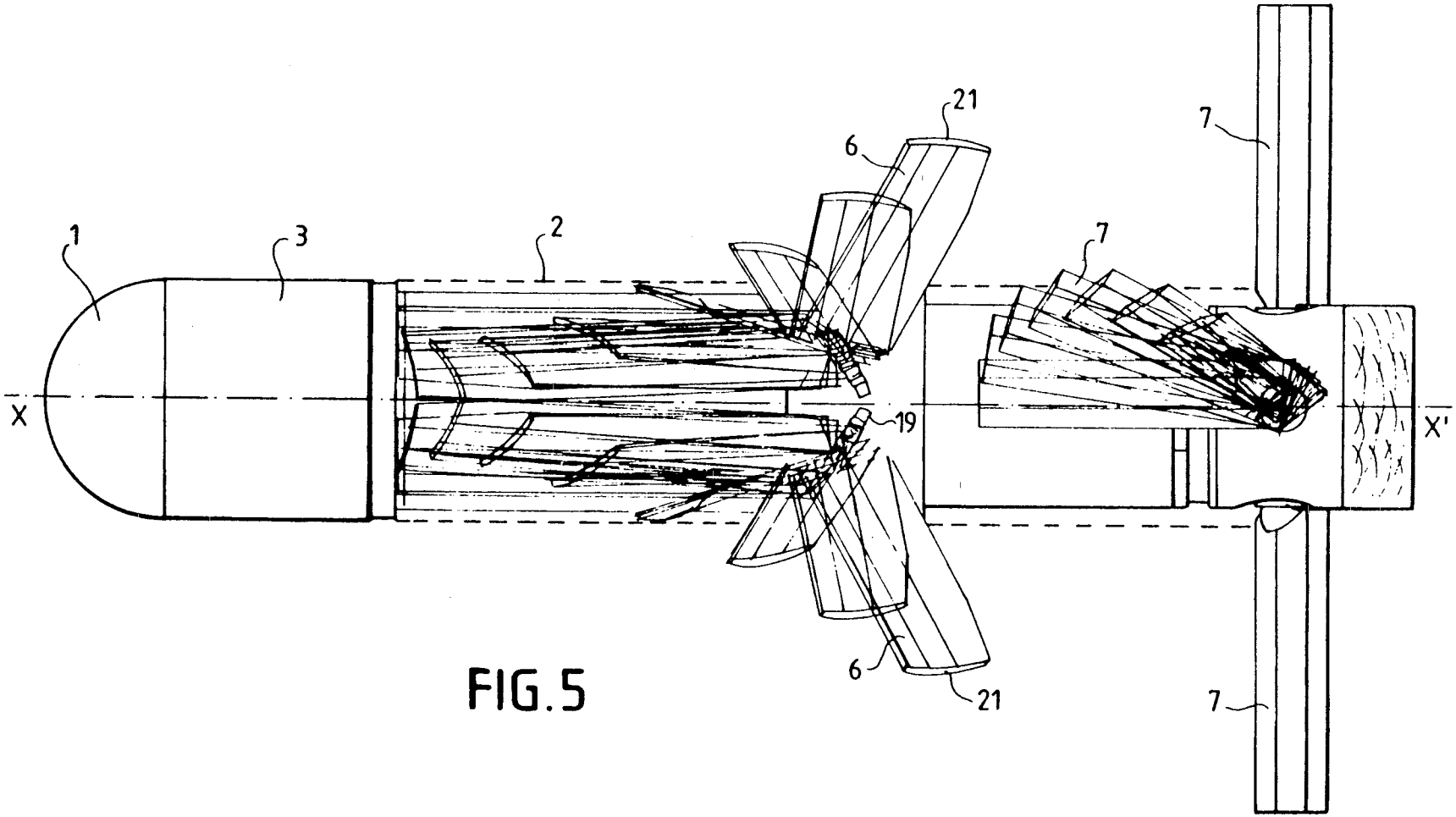
FIG. 5 represents a guided munition after ejection of the structure of the casing 2 of the munition.

The munition can comprise, for example, a guidance system positioned on the periphery of the guidance electronics 4, constituted of wings 6, for example, which can be opened out along two perpendicular axes, not shown, so that the profile of each of the wings is parallel to the longitudinal axis X'X of the munition after opening, and a stabilization system positioned on the periphery of the warhead 5 constituted of fins 7 which can be opened out using the same means of orientation as the rings, these two systems being represented in FIGS. 1 and 5. In this case, at least one system of locking and unlocking is necessary to maintain the wings and fins against the body of the munition and to liberate these wings and fins for the guided phase, to ensure the guidance and the stability of the munition. The casing 2 covering these two systems during the munition's ballistic phase will be used, in our example embodiment shown, as a system of locking and unlocking. The casing 2 represented by dashed lines in FIG. 5 covers the wings 6 and the fins 7 until the end of the ballistic phase.

When the propeller becomes inactive, means of ejection, not shown, enable the propeller to be separated from the rest of the munition. Then, as soon as the seeker 3 has detected the ground, means of opening, not represented, enable the parachute, for example, to be opened to reduce the speed of the munition. When braking is over, means of detection, for example, of the speed of the munition trigger the pressuring of the pyrotechnic piston 40 which unlocks the linking device 12 liberating the casing 2 and the parachute 8 to which it is fixed from the rest of the rear sub-assemblies. The casing 2 thus liberates, first, the wings 6 which are deployed, for example, along an oblique axis 19 so that each profile 21 of wings 6 is parallel to the longitudinal axis X'X of the munition and, secondly, the fins 7 according to the same means of orientation as those used for the wings 6.

The invention applies to any guided munition fired from a launching system with a cannon effect, the peripheral casing being fixable to any ejectable part of a munition, the propeller being a non-restrictive example.

What is claimed is:

1. A guided munition, comprising:

a front sub-assembly placed at a front of the munition and a plurality of rear sub-assemblies, including at least a first and a last rear sub-assemblies, positioned behind the front sub-assembly along a longitudinal axis of the munition;

a releasable cylindrical casing, with a rear end and a front end, positioned around the periphery of the rear sub-assemblies, fixed at its rear end to an ejectable rear sub-assembly placed at the rear of the munition, its front end resting on a rear end of the front sub-assembly, said casing comprising:

a first linking means for linking the casing to the last of the rear sub-assemblies of the munition;

a second linking means located inside said casing, which both links two of said plurality of sub-assemblies together and secures the two sub-assemblies to the casing;

a means for accessing said second linking means from outside said casing;

means for securing said front sub-assembly to said first rear sub-assembly.

2. A munition according to claim 1, wherein said first linking means comprises at least one notch positioned on an internal periphery of the casing.

3. A munition according to claim 1, wherein said first lining means is a pyrotechnic device.

4. A munition according to claim 1, wherein said means of access comprises at least a hole through the thickness of the casing.

5. A munition according to claim 1, wherein said second linking means is a ring.

6. A munition according to claim 5, wherein said ring is elastic.

7. A munition according to claim 1, wherein said securing means is placed on an external periphery of a front part of the first rear sub-assembly to enable the front sub-assembly to be fixed to the rear sub-assemblies, thereby the casing, resting on all the sub-assemblies, transmits forces due to firing by a cannon effect.

8. A munition according to claim 1, wherein the casing surrounds a guidance system and a stabilization system placed on a periphery of the rear sub-assemblies of the munition.

9. A munition according to claim 1, wherein said front sub-assembly of the munition is a seeker.

10. A munition according to claim 1, wherein said ejectable rear sub-assembly placed at the rear of the munition is a gas generator.

11. A munition according to claim 10, wherein the gas generator is a propeller.

* * * * *